US010808709B2

(12) United States Patent
Wang

(10) Patent No.: US 10,808,709 B2
(45) Date of Patent: Oct. 20, 2020

(54) FAN CAPABLE OF GENERATING OMNIDIRECTIONAL AIRFLOW

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 395 days.

(21) Appl. No.: 15/684,256

(22) Filed: Aug. 23, 2017

(65) Prior Publication Data

US 2019/0063447 A1 Feb. 28, 2019

(51) Int. Cl.

| | |
|---|---|
| ***F04D 25/08*** | (2006.01) |
| ***F04D 25/10*** | (2006.01) |
| ***F04D 19/00*** | (2006.01) |
| ***F04D 25/16*** | (2006.01) |
| ***F04D 25/06*** | (2006.01) |
| *F04D 29/32* | (2006.01) |
| *F04D 17/16* | (2006.01) |

(52) U.S. Cl.

CPC ..... *F04D 25/105* (2013.01); *F04D 19/002* (2013.01); *F04D 25/088* (2013.01); *F04D 25/10* (2013.01); *F04D 25/166* (2013.01); *F04D 17/165* (2013.01); *F04D 25/06* (2013.01); *F04D 29/325* (2013.01)

(58) Field of Classification Search

CPC ..... F04D 25/10; F04D 25/166; F04D 25/088; F04D 19/002; F04D 25/06; F04D 29/325; F04D 17/165; F04D 25/105; F04D 25/08

USPC ..... 417/354, 423.7, 423.15; 416/5, 244 R, 416/246

See application file for complete search history.

(56) References Cited

U.S. PATENT DOCUMENTS

| | | | | |
|---|---|---|---|---|
| 1,354,098 | A * | 9/1920 | Glasser | F04D 25/105 310/40.5 |
| 1,597,751 | A * | 8/1926 | Aalborg | F04D 25/105 416/100 |
| 1,610,643 | A * | 12/1926 | Aalborg | F04D 25/105 310/40.5 |
| 5,013,224 | A * | 5/1991 | Liao | F04D 25/105 416/100 |
| 6,364,638 | B1 * | 4/2002 | Liu | F04D 25/105 416/5 |
| 6,722,859 | B1 * | 4/2004 | Chen | F04D 25/088 415/60 |
| 6,913,443 | B2 * | 7/2005 | Chen | F04D 25/088 416/100 |

(Continued)

*Primary Examiner* — Peter J Bertheaud
(74) *Attorney, Agent, or Firm* — Sinorica, LLC

(57) ABSTRACT

A fan capable of generating omnidirectional airflow includes a central shaft and a fan body. A windward surface of each of blades of the fan body and a radial direction of a motor of the fan body are perpendicular to each other. The central shaft is perpendicular to an axial direction of the motor. The fan body is connected with one side of a support unit. The central shaft is connected with a rotary device. The central shaft is fixed to the support unit. The rotary device can drive the support unit to rotate relative to the central shaft. When the fan is actuated, the blades generate 360-degree outward airflow, and the support unit is rotated by the rotary device so that the fan can generate omnidirectional airflow.

6 Claims, 7 Drawing Sheets

(56) References Cited

U.S. PATENT DOCUMENTS

| | | | | |
|---|---|---|---|---|
| 7,077,629 | B2 * | 7/2006 | Chen | F04D 25/088 416/110 |
| 7,229,255 | B2 * | 6/2007 | Gajewski | F04D 25/088 416/110 |
| 7,601,005 | B1 * | 10/2009 | Lai | F04D 25/088 439/12 |
| 2004/0191066 | A1 * | 9/2004 | Chen | F04D 25/088 416/210 R |
| 2007/0297912 | A1 * | 12/2007 | Reuter | F04D 13/06 416/93 R |
| 2009/0110553 | A1 * | 4/2009 | Wu | F04D 29/263 415/211.1 |
| 2011/0171021 | A1 * | 7/2011 | VanOtten Tolman | F04D 19/024 416/1 |

* cited by examiner

FAN CAPABLE OF GENERATING OMNIDIRECTIONAL AIRFLOW

FIELD OF THE INVENTION

The present invention relates to a fan, and more particularly to a fan capable of generating omnidirectional airflow.

BACKGROUND OF THE INVENTION

A conventional ceiling fan 1 is described in U.S. Pat. No. 7,601,005. FIG. 1 is a sectional view of the conventional ceiling fan 1. FIG. 2 is a partial enlarged sectional view of the conventional ceiling fan.

The ceiling fan includes two fans 2. Each fan 2 is connected to a rotating disc 3. The rotating disc 3 is provided with a power distribution disc 4 which can be rotated 360 degrees. The power distribution disc 4 comprises a plurality of conductive ring units 5. The conductive ring units 5 are insulated from each other. Each conductive ring unit 5 includes a stator 6 and a rotor 7 which are in contact with each other. The stators 6 of the conductive ring units 5 are electrically connected with a power source, respectively. The rotors 7 of the conductive ring units 5 are electrically connected with the respective fans 2.

When the ceiling fan 1 is rotated, the rotating disc 3 is rotated 360 degrees to drive the fans 2 and the rotors 7 to rotate. Since the stators 6 and the rotors 7 of the respective conductive ring units 5 are in contact with each other, the stators 6 of the conductive ring units 5 conduct the power supply to the rotors 7 of the conductive ring units 5 and the respective fans 2 so that the fans 2 are operated. The fans 2 can be rotated 360 degrees for blowing airflow.

Although the above-described conventional ceiling fan 1 can be rotated 360 degrees. The blades of the respective fans 2 are common blades, and it can be seen that they can only blow directional airflow. The wind blowing range of the ceiling fan 1 is limited to the angle of each fan 2. The wind blowing range is narrow. Accordingly, the inventor of the present invention has devoted himself based on his many years of practical experiences to solve these problems.

SUMMARY OF THE INVENTION

The primary object of the present invention is to provide a fan capable of generating omnidirectional airflow.

In order to achieve the aforesaid object, the fan capable of generating omnidirectional airflow of the present invention comprises a fan body, a central shaft, a support unit, and a rotary device. The fan body has a motor and a plurality of blades. The blades each extend from the inside to the outside. The blades each have a windward surface. The windward surface of each of the blades and a radial direction of the motor are perpendicular to each other. The central shaft is perpendicular to an axial direction of the motor. The support unit has one side connected to the fan body. The rotary device is connected with the central shaft and fixed to the support unit. The rotary device drives the support unit to rotate relative to the central shaft.

According to the fan capable of generating omnidirectional airflow of the present invention, when the fan is actuated, the blades of the fan generate 360-degree outward airflow, and the support unit and the fan body are rotated by the rotary device so that the fan can generate omnidirectional airflow.

DETAILED DESCRIPTION OF THE PREFERRED EMBODIMENTS

Embodiments of the present invention will now be described, by way of example only, with reference to the accompanying drawings.

Figure 1:
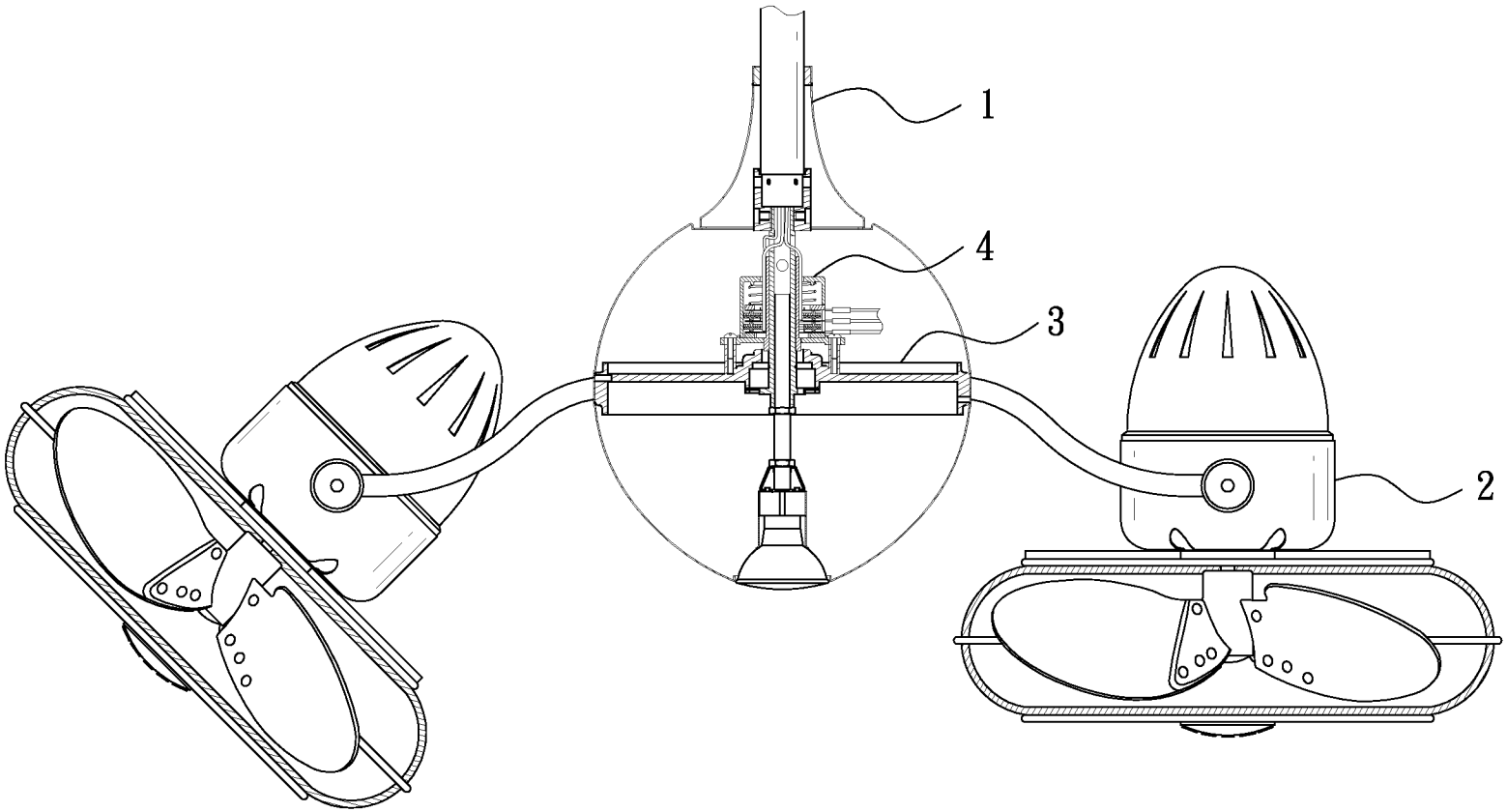
FIG. 1 Prior Art
FIG. 1 is a sectional view of a conventional ceiling fan.
Figure 2:
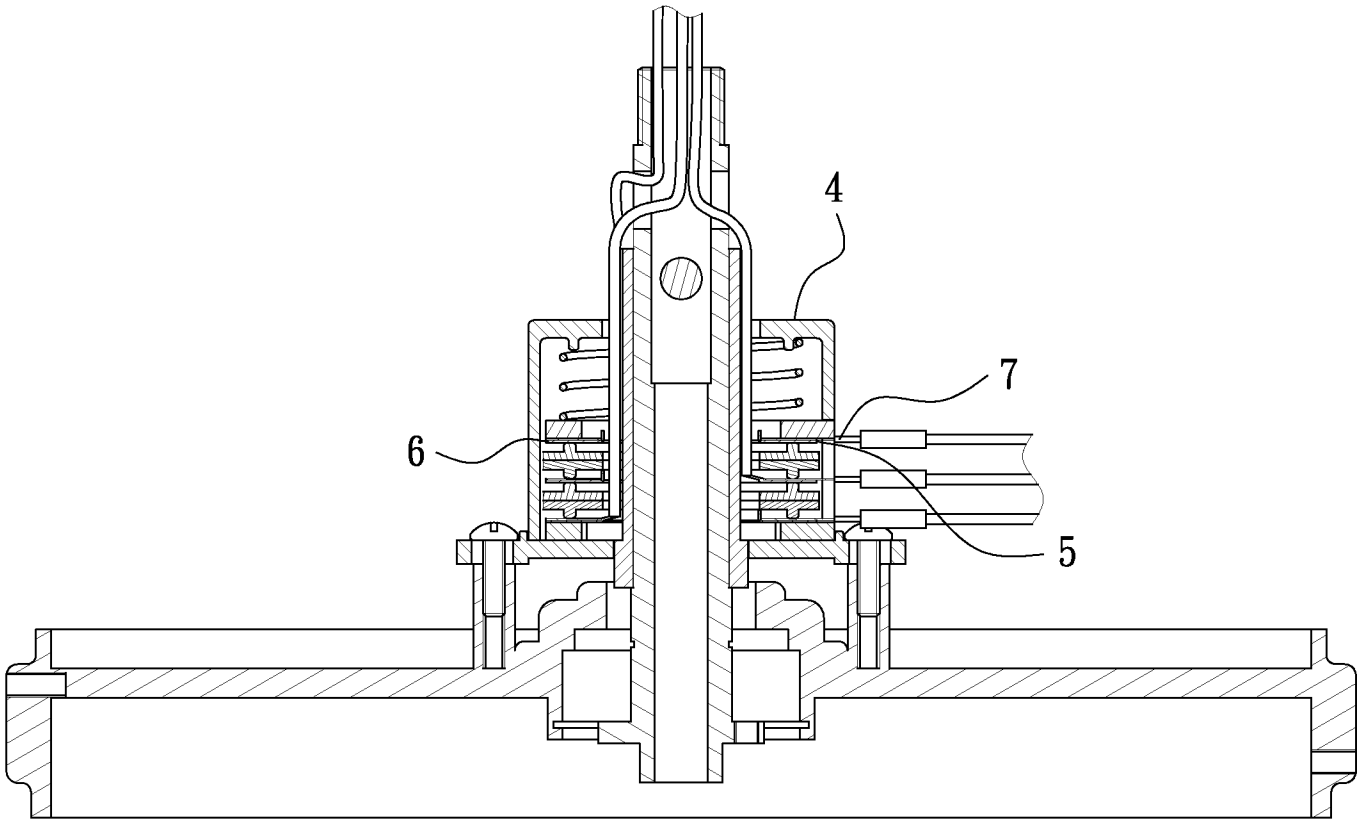
FIG. 2 Prior Art
FIG. 2 is a partial enlarged sectional view of the conventional ceiling fan, showing the power distribution disc.
Figure 3:
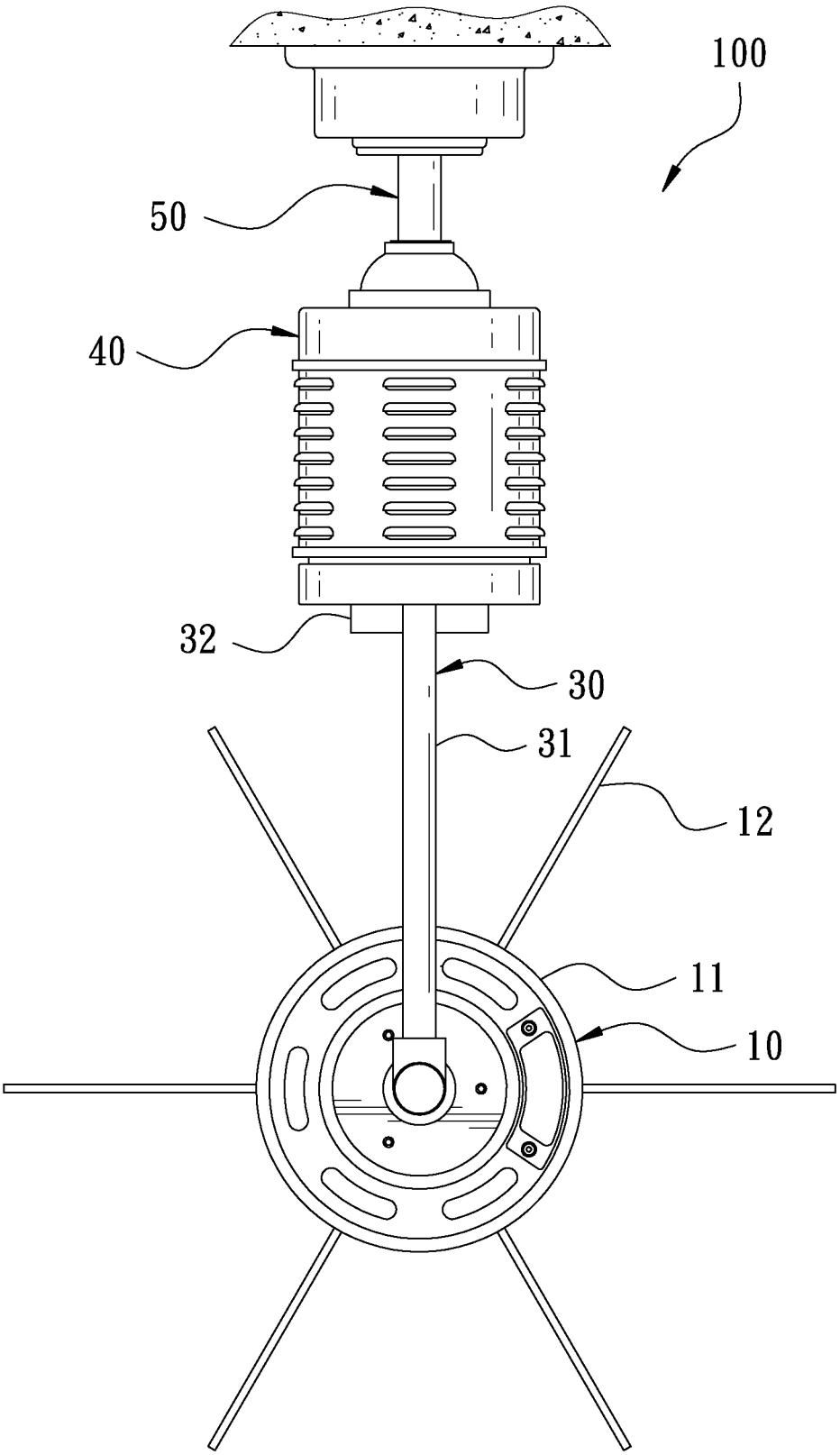
FIG. 3 is a side view of the present invention.
Figure 4:
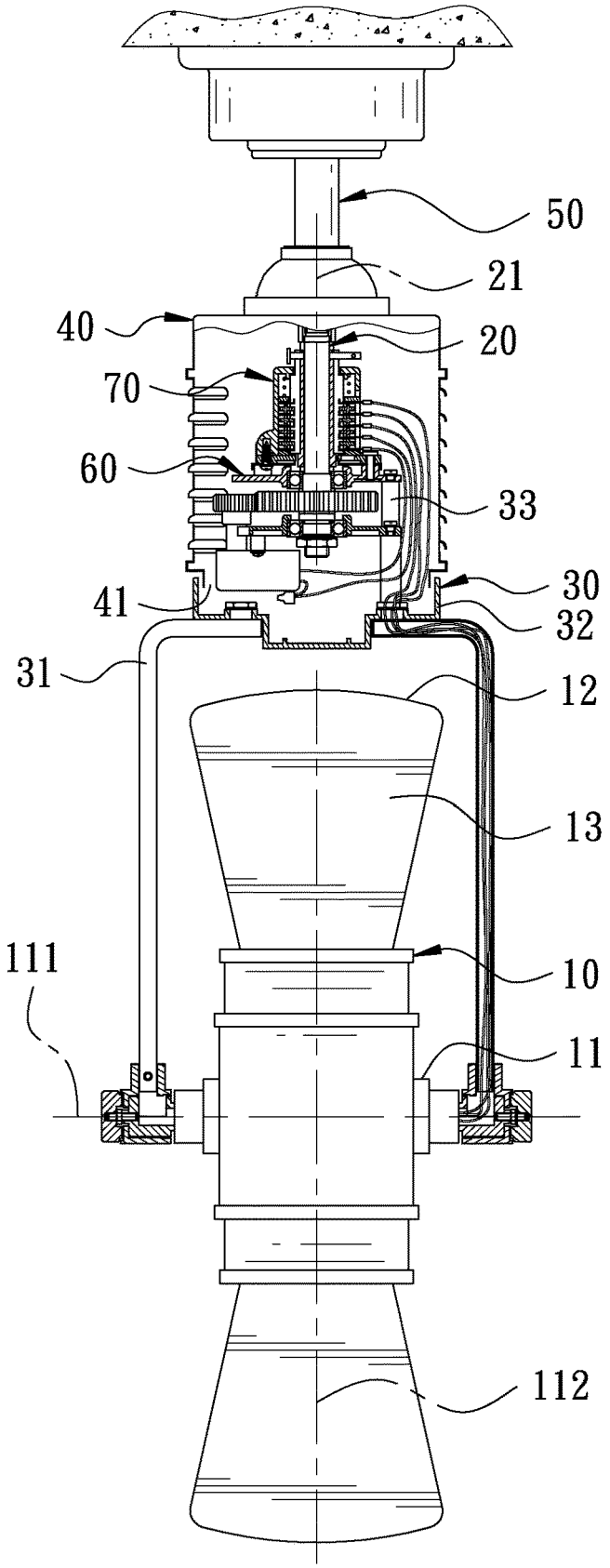
FIG. 4 is a sectional view of the present invention.
Figure 5:
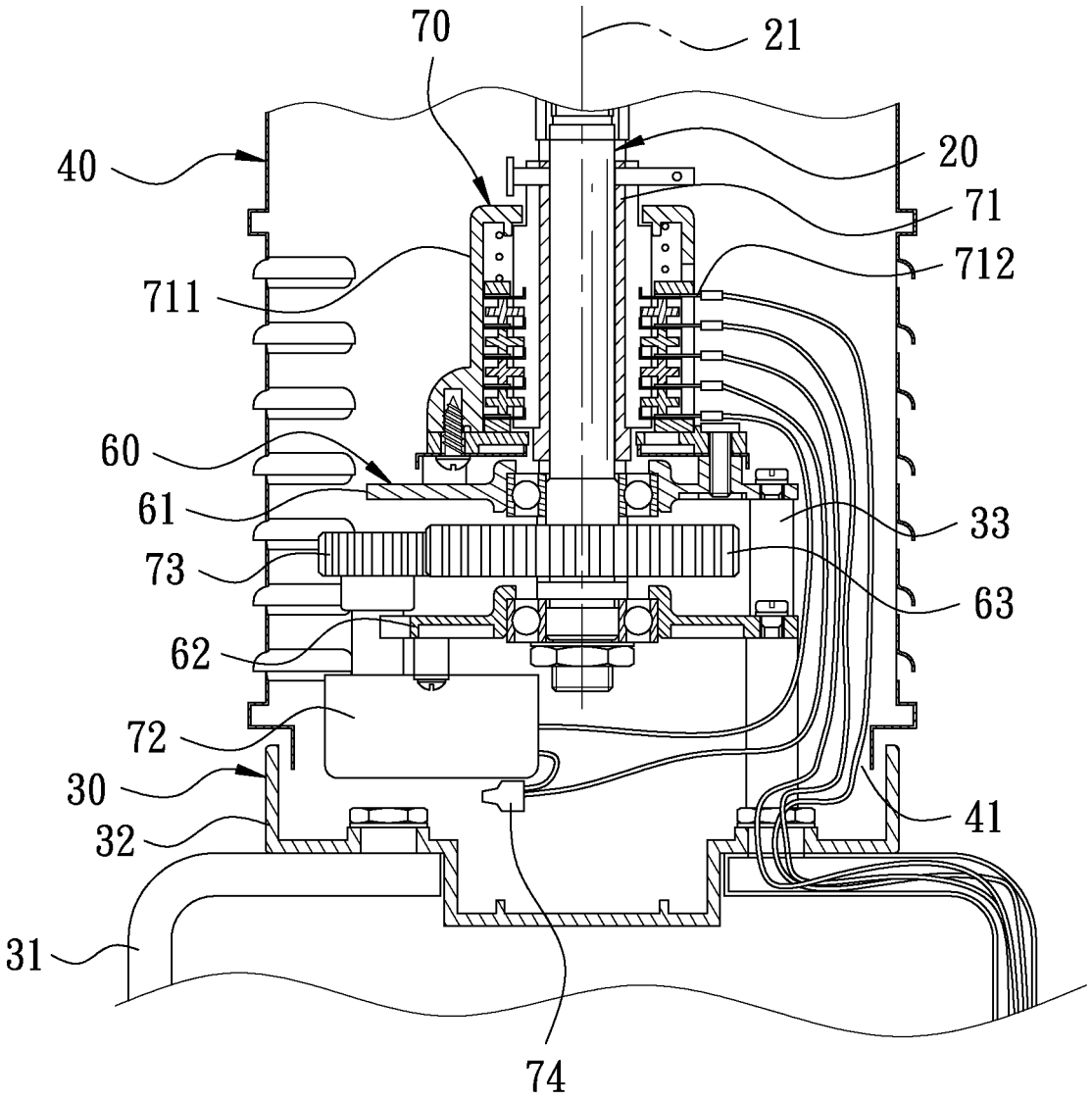
FIG. 5 is a partial enlarged view of the rotary device of the present invention.

FIG. 3 is a side view of the present invention. FIG. 4 is a sectional view of the present invention. FIG. 5 is a partial enlarged view of the rotary device of the present invention. The present invention discloses a fan 100 capable of generating omnidirectional airflow. The fan 100 comprises a fan body 10, a central shaft 20, a support unit 30, a housing 40, a suspension rod 50, a stabilizing unit 60, and a rotary device 70.

The fan body 10 has a motor 11 and a plurality of blades 12. The blades 12 each extend from the inside to the outside. Each of the blades 12 is gradually enlarged from the inside to the outside. Each of the blades 12 has a windward surface 13. The motor 11 has an axial direction 111 and a radial direction 112. The windward surface 13 of each of the blades 12 and the radial direction 112 of the motor 11 are perpendicular to each other.

The central shaft 20 is perpendicular to the axial direction 111 of the motor 11. The central shaft 20 has an axial direction 21.

The support unit 30 has one side connected to the fan body 10. In an embodiment of the present invention, the support unit 30 has two support rods 31 which are arranged symmetrically along the axial direction 21 of the central shaft 20 and a bottom disc 32. One side of each support rod 31 is fixedly connected to the fan body 10, and another side of each support rod 31 is fixedly connected to the bottom disc 32. A connecting rod 33 is fixedly connected on the bottom disc 32.

The housing 40 has an opening 41 at one side thereof. The opening 41 is adapted for the support unit 30 to extend outward. In this embodiment of the present invention, the central shaft 20 is fixed in the housing 40.

The suspension rod 50 is disposed on the housing 40. In this embodiment of the present invention, the suspension rod 50 is fixed to the ceiling.

The stabilizing unit 60 has a main rotor 61, a secondary rotor 62, and a gear plate 63. The main rotor 61 and the secondary rotor 62 are pivotally connected with the central shaft 20, respectively. One side of each of the main rotor 61 and the secondary rotor 62 is fixedly connected to the connecting rod 33 of the support unit 30. The gear plate 63 is fixedly connected to the central shaft 20.

The rotary device 70 is connected with the central shaft 20 and fixed to the support unit 30. In this embodiment of the present invention, the rotary device 70 includes a 360-degree rotating power distribution disc 71 and an actuating motor 72. The power distribution disc 71 and the actuating motor 72 are pivoted about the central shaft 20, respectively. The power distribution disc 71 is fixed to the central shaft 20. The power distribution disc 71 has a pivot portion 711. The pivot portion 711 has a plurality of conductive rings (rotors) 712. The pivot portion 711 and the conductive rings 712 are pivotally connected to the central shaft 20 through the power distribution disc 71. The pivot portion 711 of the power distribution disc 71 is fixed to the main rotor 61. The actuating motor 72 is fixedly connected to another side of the secondary rotor 62. A rotating shaft of the actuating motor 72 is engaged with the gear plate 63 through a gear 73. The conductive rings 71 are electrically connected with the motor 11 of the fan body 10 and the actuating motor 72, respectively. A switch 74 is provided between the conductive rings 712 and the actuating motor 72. The rotary device 70 drives the support unit 30 to rotate relative to the central shaft 20.

FIG. 4 is a sectional view of the present invention. FIG. 5 is a partial enlarged view of the rotary device 70 of the present invention. When the fan 100 is actuated, the power distribution disc 71 is connected with a power source. The power distribution disc 71 conducts the electric power to the conductive rings 712 of the power distribution disc 71. The detailed embodiment of the power distribution disc 71 has been described in U.S. Pat. No. 7,601,005, and will not be described hereinafter. The conductive rings 72 conduct the electric power to the switch 74, the actuating motor 72, and the motor 11 of the fan body 10, such that the motor 11 of the fan body 10 and the actuating motor 72 are actuated. Through the rotating shaft of the actuating motor 72, the gear 73, the gear plate 63 and the secondary rotor 62 of the stabilizing unit 60, the actuating motor 72 is pivoted about the central shaft 20 to further drive the connecting rod 33 of the support unit 30, the support rods 31, the bottom disc 32, the main rotor 61 of the stabilizing unit 60, the pivot portion 711 of the power distribution disc 71, the conductive rings (rotors) 712, and the fan body 10 to rotate about the central shaft 20 for 360-degree rotation.

Figure 6:
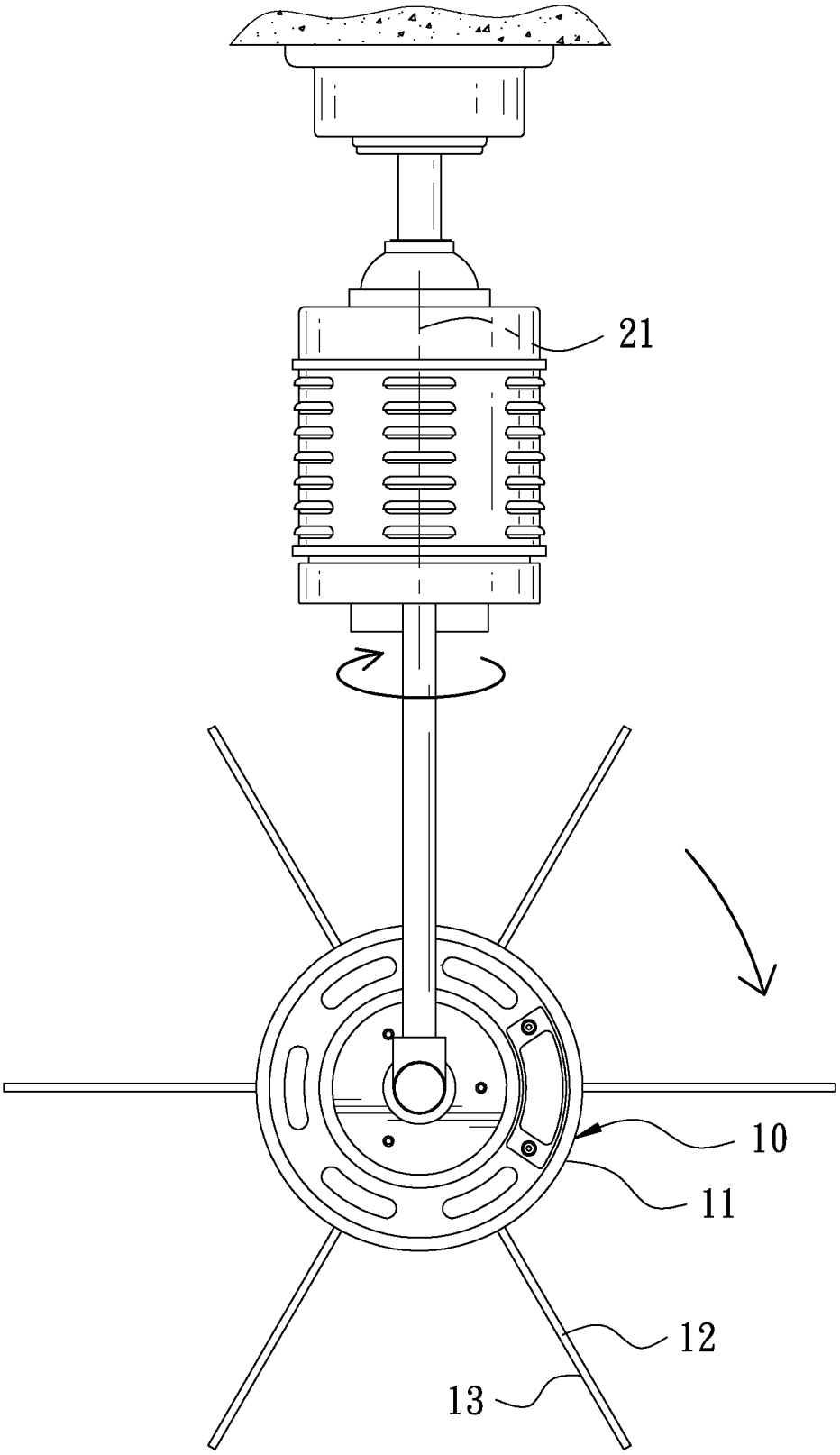
FIG. 6 is a schematic view of the present invention when in use, showing that the fan 100 generates omnidirectional airflow.

Please refer to FIG. 4 to FIG. 6. FIG. 6 shows that the fan 100 generates omnidirectional airflow. Since each blade 12 of the fan body 10 extends from the inside to the outside, and the windward surface 13 of each blade 12 and the radial direction 112 of the motor 11 are perpendicular to each other to form a waterwheel blade fan, which generates continuous 360-degree airflow to greatly increase the range of the blowing airflow. When the rotary device 70 drives the fan body 10 to rotate about the central shaft 20 for 360-degree rotation, it is possible to generate omnidirectional airflow.

Figure 7:
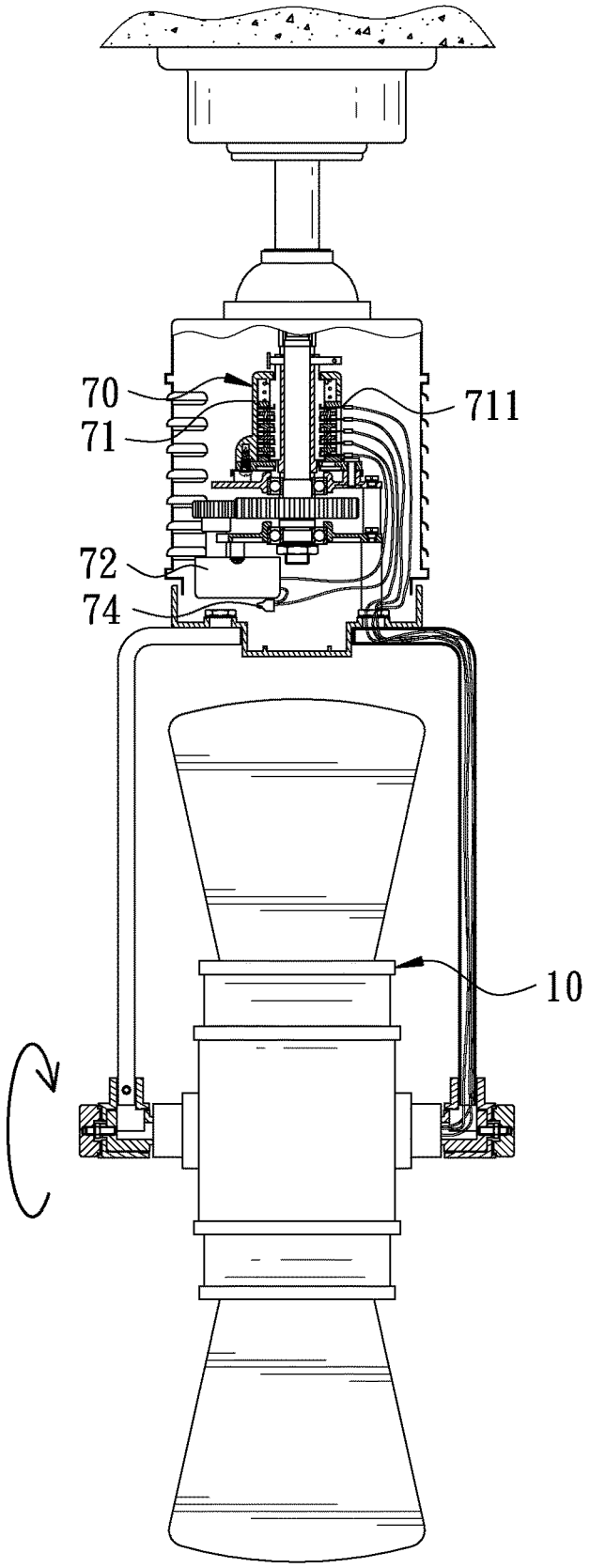
FIG. 7 is a schematic view of the present invention when in use, showing that the fan 100 generates 360-degree outward airflow.

FIG. 7 is a schematic view of the present invention when in use, showing that the fan 100 generates 360-degree outward airflow. Since the switch 74 is provided between the conductive rings 712 and the actuating motor 72, when the user wants to have the airflow blown at a specific range, the actuating motor 72 can be stopped by the switch 74, causing the fan body 10 to generate 360-degree airflow at the specific angle.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fan capable of generating omnidirectional airflow, comprising:

a fan body, having a motor and a plurality of blades, the blades each extending from an inside to an outside thereof, the blades each having a windward surface, the windward surface of each of the blades and a radial direction of the motor being perpendicular to each other;

a central shaft, perpendicular to an axial direction of the motor;

a support unit, having one side connected to the fan body;

a rotary device, connected with the central shaft and fixed to the support unit, the rotary device driving the support unit to rotate relative to the central shaft, the rotary device including a 360-degree rotating power distribution disc and an actuating motor, the power distribution disc and the actuating motor being pivoted about the central shaft, respectively; and a stabilizing unit, the stabilizing unit having a main rotor, a secondary rotor and a gear plate, the main rotor and the secondary rotor being pivotally connected with the central shaft respectively, one side of each of the main rotor and the secondary rotor being fixedly connected to the support unit, the gear plate being fixedly connected to the central shaft;

wherein the power distribution disc is fixedly connected to the central shaft, the power distribution disc has a pivot portion, the pivot portion has a plurality of conductive rings, the pivot portion and the conductive rings are pivotally connected with the central shaft through the power distribution disc, the conductive rings are electrically connected with the motor and the actuating motor respectively, and a switch is provided between the conductive rings and the actuating motor.

2. The fan capable of generating omnidirectional airflow as claimed in claim 1, wherein the pivot portion of the power distribution disc is fixedly connected to the main rotor, the actuating motor is fixedly connected to another side of the secondary rotor, a rotating shaft of the actuating motor is engaged with the gear plate through a gear.

3. The fan capable of generating omnidirectional airflow as claimed in claim 1, wherein the support unit has two support rods which are arranged symmetrically along the axial direction of the central shaft and a bottom disc, one side of each support rod is fixedly connected to the fan body, another side of each support rod is fixedly connected to the bottom disc, a connecting rod is fixedly connected on the bottom disc, the side of each of the main rotor and the secondary rotor is fixedly connected to the connecting rod of the support unit.

4. The fan capable of generating omnidirectional airflow as claimed in claim 1, further comprising a housing, the housing having an opening at one side thereof, the opening being adapted for the support unit to extend outward.

5. The fan capable of generating omnidirectional airflow as claimed in claim 4, further comprising a suspension rod, the suspension rod being disposed on the housing.

6. The fan capable of generating omnidirectional airflow as claimed in claim 1, wherein each of the blades is gradually enlarged from the inside to the outside.

* * * * *